US008997732B2

(12) United States Patent
Oagley et al.

(10) Patent No.: US 8,997,732 B2
(45) Date of Patent: Apr. 7, 2015

(54) METHOD AND APPARATUS FOR THE THERMAL PROTECTION OF LED LIGHT MODULES IN A RANGE HOOD APPLIANCE

(75) Inventors: Howard James Oagley, Louisville, KY (US); Justin Tyler Brown, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1148 days.

(21) Appl. No.: 12/968,865

(22) Filed: Dec. 15, 2010

(65) Prior Publication Data

US 2012/0152228 A1 Jun. 21, 2012

(51) Int. Cl.

| | |
|---|---|
| ***F21V 29/02*** | (2006.01) |
| *F21W 131/307* | (2006.01) |
| *F24C 15/20* | (2006.01) |
| *H01J 61/52* | (2006.01) |

(52) U.S. Cl.

CPC ..... *F24C 15/2064* (2013.01)

(58) Field of Classification Search

CPC ..... F21S 48/32; F21S 48/321; F21S 48/323; F21S 48/328; F24C 15/008; F24C 15/2092; F24C 15/2064; F21W 2131/307; F21V 29/004; F21V 29/002; F21V 29/2293; H01J 61/52

USPC ..... 126/299 R, 213; 362/92, 264, 373

See application file for complete search history.

(56) References Cited

U.S. PATENT DOCUMENTS

| | | | | |
|---|---|---|---|---|
| 5,287,253 | A * | 2/1994 | Blorstad | 362/92 |
| 6,969,834 | B2 * | 11/2005 | Kaji et al. | 219/620 |
| 7,108,399 | B2 * | 9/2006 | Miyawaki et al. | 362/294 |
| 7,109,450 | B2 * | 9/2006 | Kaji et al. | 219/620 |
| 7,699,051 | B2 * | 4/2010 | Gagas et al. | 126/299 D |
| 7,874,690 | B2 * | 1/2011 | Weber et al. | 362/92 |
| 8,111,209 | B2 * | 2/2012 | Chui | 345/31 |
| 8,459,848 | B2 * | 6/2013 | Marley | 362/521 |
| 8,618,443 | B2 * | 12/2013 | Inoue et al. | 219/202 |
| 2003/0006230 | A1 * | 1/2003 | Kaji et al. | 219/620 |
| 2004/0221839 | A1 * | 11/2004 | Plankl et al. | 126/299 D |
| 2004/0264168 | A1 * | 12/2004 | Gotz et al. | 362/92 |
| 2006/0278216 | A1 * | 12/2006 | Gagas et al. | 126/299 D |

(Continued)

FOREIGN PATENT DOCUMENTS

| | | | | |
|---|---|---|---|---|
| JP | 2007078223 | A * | 3/2007 | |
| JP | 2009216307 | A * | 9/2009 | |
| WO | WO 03/073009 | A1 * | 9/2003 | F24C 15/20 |

OTHER PUBLICATIONS

"12968865_2014-05-29_CN_1971149_A_M.pdf".*

*Primary Examiner* — Gregory Huson
*Assistant Examiner* — Daniel E Namay
(74) *Attorney, Agent, or Firm* — Dority & Manning, P.A.

(57) ABSTRACT

A method and apparatus for the thermal protection of LED light modules in a range hood appliance is provided. If the temperature of the LED light module reaches a predetermined temperature, one or more protective actions are taken to prevent over heating the LED light module. Such protective actions can include e.g., decreasing and/or terminating the power to the LED light module, opening a damper to provide air for cooling the LED light module, and/or activating a fan to provide forced convection cooling of the LED light module.

9 Claims, 3 Drawing Sheets

(56) References Cited

U.S. PATENT DOCUMENTS

| | | | | |
|---|---|---|---|---|
| 2008/0258636 | A1* | 10/2008 | Shih et al. | 315/185 R |
| 2009/0002270 | A1* | 1/2009 | Chui | 345/31 |
| 2009/0013570 | A1* | 1/2009 | Grajcar | 40/552 |
| 2009/0141506 | A1 | 6/2009 | Lan et al. | |
| 2009/0316385 | A1* | 12/2009 | Weber et al. | 362/92 |
| 2009/0323341 | A1* | 12/2009 | Chui | 362/249.02 |
| 2010/0053968 | A1* | 3/2010 | Burns | 362/253 |
| 2010/0074610 | A1* | 3/2010 | Trevelyan | 396/158 |
| 2011/0037412 | A1* | 2/2011 | Kim | 315/294 |
| 2012/0152227 | A1* | 6/2012 | Oagley et al. | 126/299 D |
| 2012/0152228 | A1* | 6/2012 | Oagley et al. | 126/299 R |

* cited by examiner

FIG. —1—

METHOD AND APPARATUS FOR THE THERMAL PROTECTION OF LED LIGHT MODULES IN A RANGE HOOD APPLIANCE

FIELD OF THE INVENTION

The present invention relates to a method and apparatus for the thermal protection of LED light modules in a range hood appliance.

BACKGROUND OF THE INVENTION

Range hoods provide for the treatment of heat and fumes generated during cooking. These kitchen appliances are frequently provided with light sources to provide for illumination of a cook-top or other cooking appliance located below the range hood. Various configurations of the light sources can be used in order to provide sufficient illumination for a user during cooking.

For example, a range hood or an over the range microwave oven with a built in hood may include several light sources located along a bottom surface in order to light up a cook top. Such lighting may be important to the user as the cook top will typically have several heating elements positioned on a horizontal surface for the cooking of food contained in pots and pans. Proper lighting allows the user to monitor the cooking of the food and determine when the food has been properly cooked.

In range hood applications, LED lights have certain advantages as compared to incandescent or other types of lights. Such advantages can include e.g., resistance to vibration, long life expectancy, relatively low energy use compared to the lumen output, durability for repeated on-off switching, and compactness. In addition, where more light is needed, LED lights can be grouped together to increase the intensity of the light output.

However, there are certain challenges to using LED lights in a kitchen appliance. LED lights can produce a significant amount of heat, and their use in a range hood can also expose them to heat generated during cooking. For example, where LED lights are positioned in a range hood to provide lighting above the cook top, heat coming from the cook top and/or an associated oven will rise up and through the range hood. Depending upon the placement of the LED lights, this heat can provide further temperature problems for LED lights by advancing the temperature increase during use.

Unfortunately, LED lights and are susceptible to poor operation if their temperature rises too high. More particularly, there is generally a narrow range of temperatures at which LED lights can efficiently produce their maximum light output or most efficient light output. In addition, if temperature elevates above a certain range, the LED lights can be damaged or even destroyed. As such, a range hood must provide for proper thermal protection for the LED lights and associated electronics such as a printed circuit board (PCB) during operation.

Accordingly, a system for the thermal protection of LED light modules and associated electronics in a kitchen range hood would be useful. A system that can detect the temperature of the LED light module and take one or more steps to prevent an unsafe or deleterious temperature condition would be beneficial. Such a system that can be readily incorporated within the overall design of a range hood would also be very useful.

BRIEF DESCRIPTION OF THE INVENTION

Aspects and advantages of the invention will be set forth in part in the following description, or may be obvious from the description, or may be learned through practice of the invention.

In one exemplary aspect, the present invention provides a method for thermal protection of an LED light module in a range hood appliance. The method includes the steps sensing the temperature of the LED light module during operation; and initiating at least one protective action in order to effect a reduction in the temperature of the LED light module if the temperature of the LED light module from the sensing step is greater than a predetermined temperature, $T_{THR}$.

In another exemplary embodiment of the present invention, a range hood appliance is provided having thermal protection for an LED light module. The range hood includes a fan for pulling air into the range hood, and a duct for routing the flow of air through the range hood. An LED light module is positioned in the range hood. The LED light module provides for illumination of a surface located near the range hood. A temperature device for measuring the temperature of the LED light module is provided. The range hood also includes means for initiating at least one protective action in order to effect a reduction in the temperature of the LED light module if the temperature of the LED light module as measured by the temperature device is greater than a predetermined temperature, $T_{THR}$.

In still another exemplary embodiment, the present invention provides a range hood appliance that includes a fan for pulling air into the range hood. A duct is provided for routing the flow of air through the range hood. An LED light module is positioned in the range hood. The LED light module provides for illumination of a surface located near the range hood. A bi-metal switch is positioned in proximity to the LED light module and is configured for initiating at least one protective action if the temperature of the LED light module rises to a predetermined temperature, $T_{THR}$.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
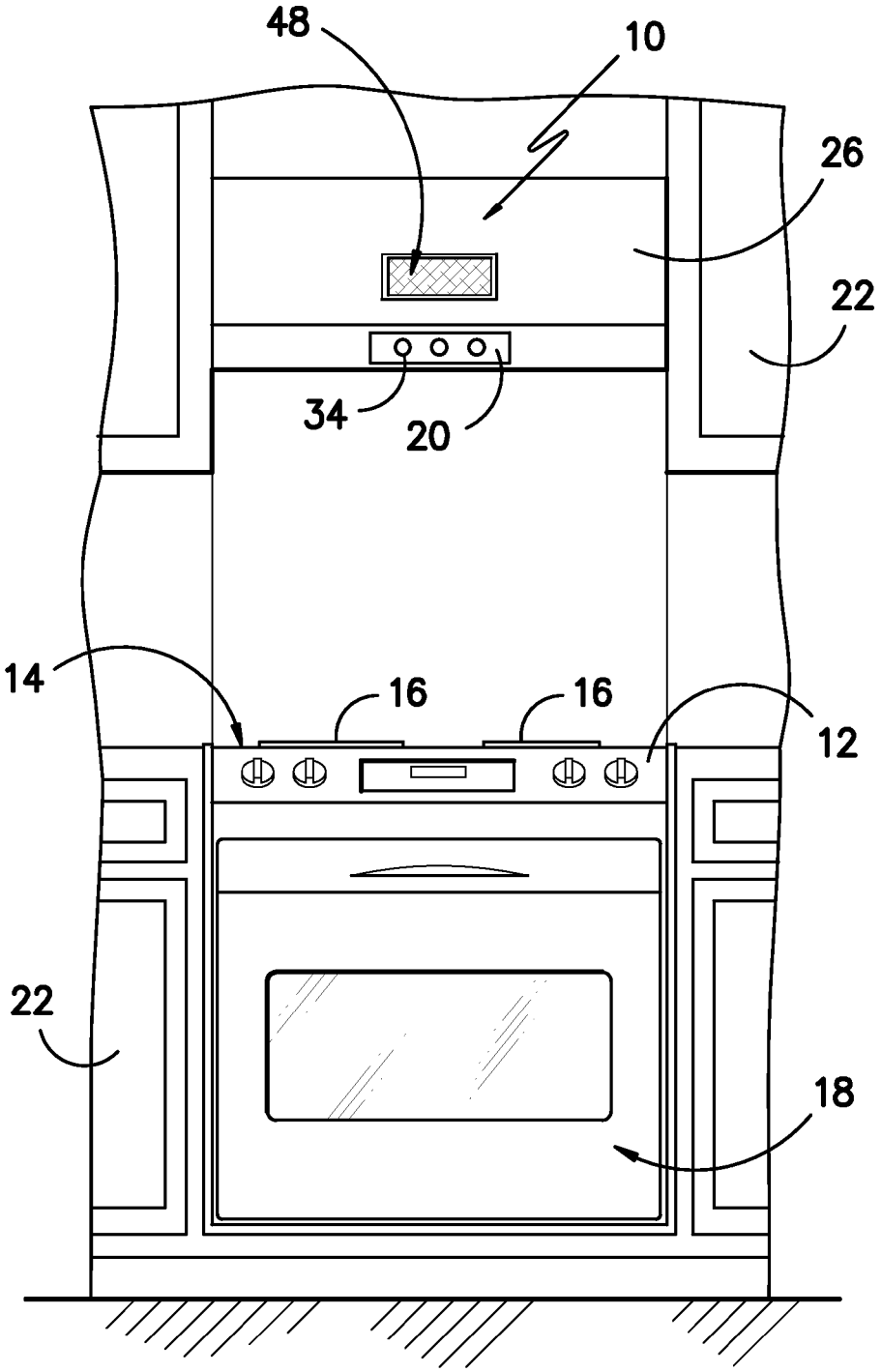
FIG. 1 provides an exemplary embodiment of an appliance, in this example a range hood, as may be used with the present invention.

The present invention provides a method and apparatus for the thermal protection of LED light modules in a range hood appliance. If the temperature of the LED light module reaches a predetermined temperature, one or more protective actions are taken to prevent over heating the LED light module. Such protective actions can include e.g., decreasing and/or terminating the power to the LED light module, opening a damper to provide air for cooling the LED light module, and/or activating a fan to provide forced convection cooling of the LED light module.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exemplary embodiment of the present invention as a range hood 10 installed within kitchen cabinetry 22. Range hood 10 includes a user interface 20 that has multiple controls 34 as may be used to activate one or more fans, lights, and/or other features Although manual controls 34 are shown, other controls such as e.g., a touch screen or slide switch configurations made be used as well.

Range hood 10 is positioned over an oven 12 that includes a horizontal, cook-top surface 14 having multiple heating elements 16 positioned thereon. Heating elements 16 may be e.g., electrically-powered or gas fueled and provide heat for cooking food placed into pots or pans and positioned onto such elements 16. Oven 12 includes a cavity, positioned behind door 18, into which food items may be placed for baking and/or broiling.

Range hood 10 is provided by way of example only. Other configurations may be used within the spirit and scope of the present invention. For example, range hood 10 could be part of a micro-wave or other cooking appliance designed to be located over e.g., a cook-top. The canopy 26 of range hood 10 could also be provided with other shapes or styles. Still other constructions may be used as well.

During operation of oven 12, heat and cooking fumes are generated from heating elements 16 and/or the baking or broiling in the oven cavity. This heat will rise upwardly, towards range hood 10. As such, at least some of the heat from cooking operations will heat range hood 10 and its associated lighting and other electronic features.

Figure 2:
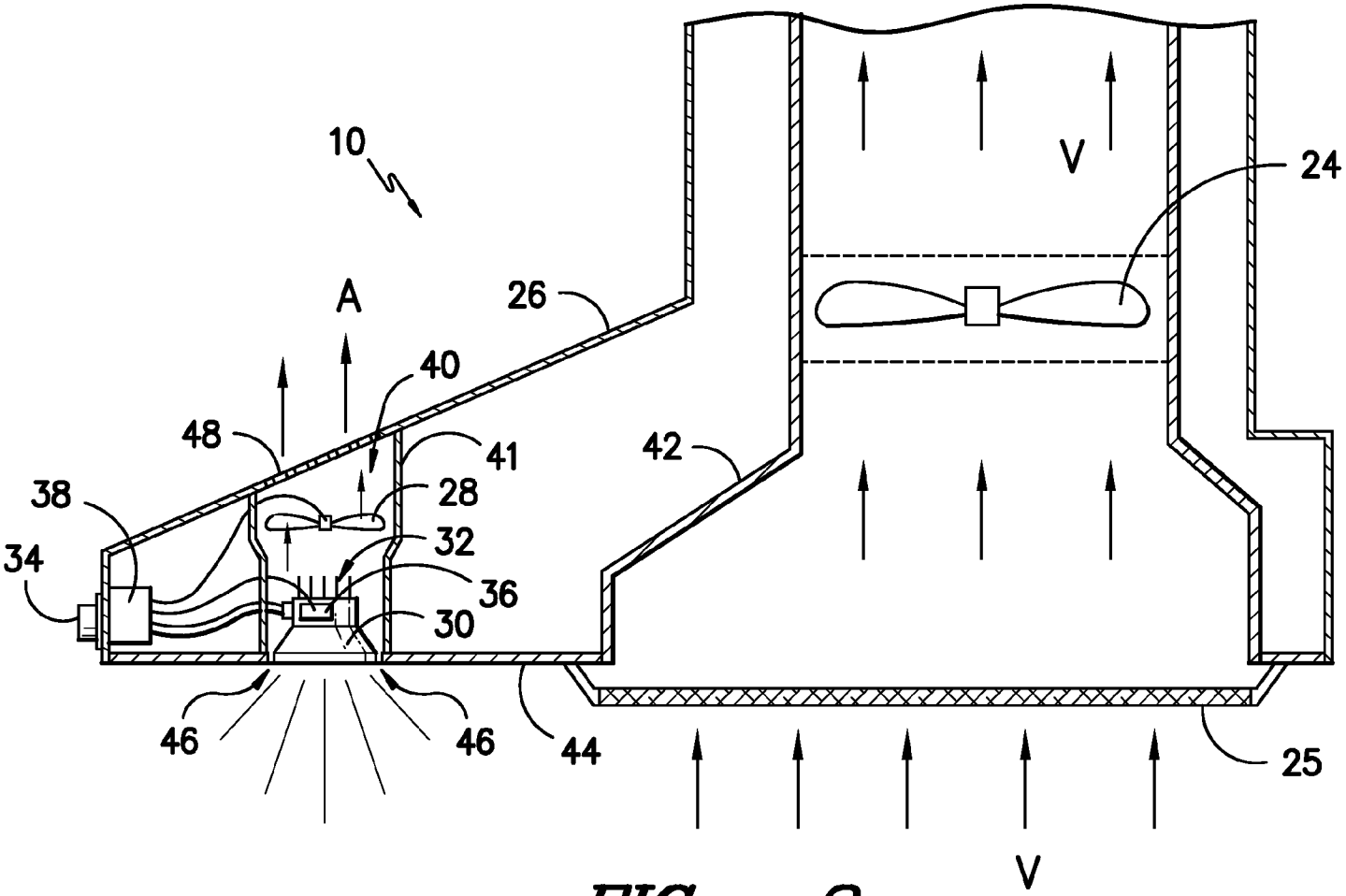
FIG. 2 provides a cross-sectional view of an exemplary embodiment of a range hood as may be used with the present invention.

FIG. 2 provides a cross-sectional view of an exemplary embodiment of a range hood 10. A fan 24 is positioned with a vent duct 42 that routes air flow (shown by arrows A) through range hood 10. More particularly, when activated, fan 24 pulls air upon into range hood 10 for travel through vent duct 42 to an exhaust. The air includes heated air and cooking fumes generated by operation of oven 12. The air is pulled through a filter screen 25 that operates to remove grease and other entrained particles from the air.

Range hood 10 includes an LED lighting module 30 projecting through panel 44. Although only one LED lighting module 30 is shown, it should be understood that multiple modules 30 may be used within the spirit and scope of the present invention and may be placed in locations other than what is shown in FIG. 2. LED lighting module 30 provides illumination of cook-top surface 14 for cooking operations thereon.

Range hood 10 is also equipped with features that provide thermal protection for LED lighting module 30. More particularly, a processing device 38 is configured with one or more features that operate to prevent LED lighting module 30 from reach temperatures that degrade its performance and/or cause damage. As used herein, processing device can include one or more processing devices such as microprocessors, printed circuit boards, and/or other electronic elements that can be configured to operate range hood 10 as described herein.

Processing device 38 is connected with a temperature sensor 32 or other device for measuring the temperature of LED lighting module 30. As shown in FIG. 2, sensor 32 is attached directly to LED lighting module 30. However, other placements of sensor 32 may be used as well. In addition, a variety of constructions can be used for sensor 32. For example, temperature sensor 32 may be a thermocouple, a negative temperature coefficient thermistor, a positive temperature coefficient thermistor, and/or a resistance temperature detector.

Temperature sensor 32 provides temperature measurements to processing device 38. In the event a temperature greater than a predetermined temperature, $T_{THR}$, is measured by temperature sensor 32, processing device 38 is configured to initiate one or more protective actions in order to reduce the temperature of LED light module 30. $T_{THR}$ is a threshold temperature at which further operation of LED lighting module is unwanted because of e.g., negative effects of the temperature on LED performance and/or because further operation could damage LED lighting module 30.

For example, if $T_{THR}$ is reached, processing device 38 is configured to reduce the power to LED light module 30. Such reduction in power will reduce the light output of LED module 30 but will also reduce the amount of heat generated by module 30 and, therefore, allow its temperature to drop. In the event the temperature of module 30 drops to an acceptable, predetermined temperature $T_{GO}$, processing device 38 is configured to restore the power to LED lighting module 30. Alternatively, processing device 38 can also be configured to terminate power to LED light module 30 once $T_{THR}$ is reached as reported by temperature sensor 32. As the temperature of module 30 cools to an acceptable operating temperature $T_{GO}$, then processing device 38 can reactivate power to LED lighting module 30.

In still another configuration of processing device 38, a failsafe feature can be used to prevent damage to LED lighting module 30. More specifically, while $T_{THR}$ may be set as the temperature at which the performance of LED lighting module 30 is degraded without permanent damage, $T_{OFF}$ represents the temperature at which further operation of LED lighting module 30 may cause permanent damage to LED lighting module 30. As such, processing device 38 can be configured to terminate power to LED lighting module if $T_{OFF}$ is reached. The configuration of processing device 38 with both a $T_{THR}$ and $T_{OFF}$ temperature allows for e.g., the power to module 30 to be terminated in the event a reduction in power at $T_{THR}$ does not result in a temperature reduction and, instead, the temperature continues to increase. Such could be the case when the heating or LED lighting module 30 is due to continuous heating provided by cooking with oven 12.

Processing device 38 can be configured with still other features as an alternative, or in addition to, those described above for the thermal protection of module 30. Referring again to FIG. 2, processing device 38 can be configured to activate an auxiliary fan 28 when temperature sensor 32 reports a temperature for LED light module 30 that is above $T_{THR}$. Auxiliary fan 28 is positioned in a channel 40 defined by walls 41. During operation of auxiliary fan 28, air is pulled through openings 46 to create an air flow indicated by arrows A. As air passes around LED light module 30 and across its cooling fins 36, the temperature of LED light module 30 can be reduced by forced convection. The now heated air exits channel 40 through openings in a screen 48 on range hood 10 (see FIGS. 1 and 2). As stated, auxiliary fan 28 can be activated as an alternative to the power reduction described above, or in addition thereto in the event power reduction does not effectively reduce the temperature of LED light module 30. It should also be understood that the routing of channel 40 can be according to configurations other than those shown in FIG. 2.

Figure 3:
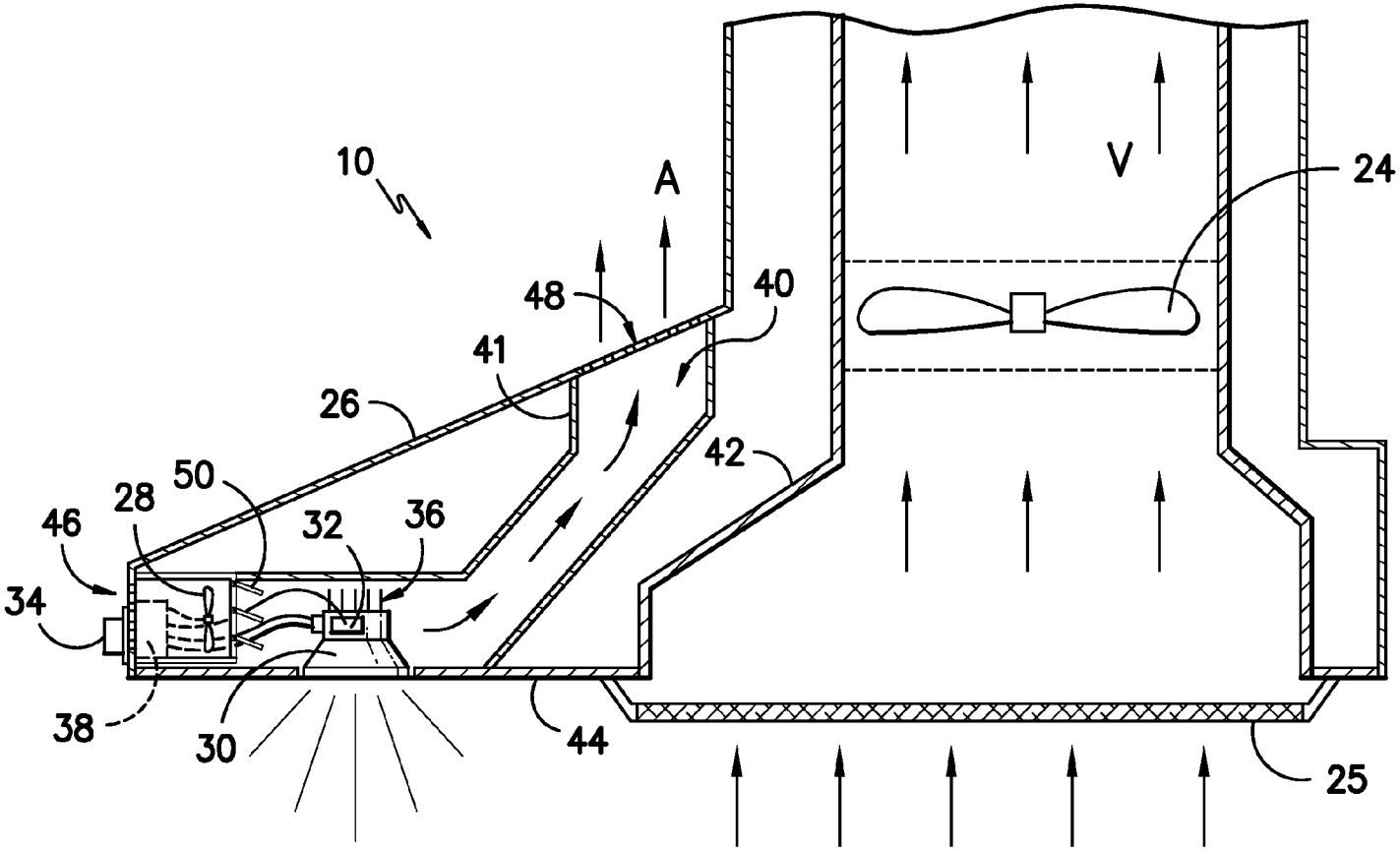
FIG. 3 provides a cross-sectional view of another exemplary embodiment of a range hood as may be used with the present invention.

FIG. 3 provides still another exemplary embodiment of a range hood 10 according to the present invention. Range hood 10 includes a processing device 38 that can be configured as previously described with regard to the exemplary embodiment of FIG. 2. In addition, range hood 10 is equipped with dampers 50 that can be opened (the position shown in FIG. 3) to allow for the inflow of air through openings 46 on the front of range hood 10. The dampers 50 can be operated between a closed and open position whenever e.g., the temperature of LED lighting module 30 reaches $T_{THR}$. As the temperature of air around LED lighting module 30 is heated, the warmer air will rise as shown by arrows A even if fan 28 is not operating. In a process of natural convection, this warmer air will be replaced by cooler air entering through openings 46. The resulting air flow through channel 40 will help cool LED lighting module 30.

In addition to opening dampers 50, processing device can also be configured to activate auxiliary fan 28 to provide forced convective cooling of LED lighting module 30. More particularly, fan 28 will cause air to flow past LED lighting module 30 at a velocity greater than flow caused solely by natural convection and, as such, can contribute to more effective cooling of module 30. The activation of fan 28 can occur with the opening of dampers 50 or, alternatively, after the opening of dampers 50 as an additional measure for cooling module 50 when the opening of dampers 50 is not sufficient.

Using the teachings disclosed herein, one of skill in the art will understand that various other configurations may be used for air channel 40. For example, instead of exhausting air through openings in screen 48, channel 40 can be routed to exhaust into the air flow created by fan 24 and upstream of fan 24. In this way, auxiliary fan 28 can be eliminated as fan 24 will provide suction for drawing air through channel 40. As such, based on temperature measurements from sensor 32, the processing device can activate fan 24 to provide cooling for LED light module 30. Dampers 50 can still be used or can also be eliminated in this exemplary embodiment. Other locations can also be used for outlet of air from channel 40. Similarly, opening 46 for the inflow of air need not be positioned only as shown in FIG. 3; other locations on range hood 10 may be used to provide incoming air for channel 40.

The exemplary embodiments of FIGS. 2 and 3 each including one or more processing devices 38 configured for operation as described. However, where desired, other devices may also be used for initiating protective action to effect a temperature reduction of LED lighting module 30. For example, an electro-mechanical device such as one or more bi-metallic switches may be used to perform certain protective actions in the event of an undesirable temperature rise. The bi-metallic switches are positioned close enough to the LED light module 30 to receive heat generated by module 30. Such bi-metallic switches could be arranged in a series according to a logic flow that provides for reducing the power to LED lighting module 30, activating auxiliary fan 28, and/or terminating power to LED lighting module 30. A variety of configurations of bi-metallic switches can be arranged to perform such functions as will be understood by one or ordinary skill in the art using the teachings disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A range hood appliance, comprising:

a fan for pulling air into the range hood;

a first duct for routing the flow of air through the range hood;

a second duct separate from the first duct;

an LED light module positioned at least partially in the second duct, said LED light module providing for illumination of a surface located near the range hood;

a temperature device for measuring the temperature of said LED light module; and means for initiating at least one protective action in order to effect a reduction in the temperature of said LED light module if the temperature of said LED light module as measured by said temperature device is greater than a predetermined temperature, $T_{THR}$.

2. A range hood appliance as in claim 1, wherein said temperature device is selected from one or more of the group comprising a thermocouple, a negative temperature coefficient thermistor, a positive temperature coefficient thermistor, and a resistance temperature detector.

3. A range hood appliance as in claim 1, wherein said means for initiating at least one protective action is selected from one or more of the group comprising a processing device configured for reducing the power supplied to said LED light module, a processing device configured for activating a fan to provide forced convection cooling of said LED light module, and a processing device configured for opening a damper to allow air from the exterior of the range hood to be pulled into the range hood to provide convective cooling of the LED light module.

4. A range hood appliance as in claim 1, wherein said processing device is further configured for determining the temperature of the LED light module after reducing the power supplied to said LED light module and, if the temperature of the LED light module is less than a certain predetermined temperature, $T_{GO}$, then restoring the power to the LED light module.

5. A range hood appliance as in claim 1, wherein said means for initiating at least one protective action comprises a processing device configured for terminating the power to said LED light module if the temperature reaches a certain predetermined temperature, $T_{OFF}$.

6. A range hood appliance as in claim 1, wherein the first duct defines a cooling airflow and wherein the second duct defines an exhaust airflow.

7. A range hood appliance as in claim 6, wherein the cooling airflow terminates in the exhaust airflow.

8. A range hood appliance, comprising:

a fan for pulling air into the range hood;

a first duct for routing the flow of air through the range hood;

a second duct separate from the first duct;

an LED light module positioned at least partially in the second duct, said LED light module providing for illumination of a surface located near the range hood; and a bi-metallic switch positioned in proximity to said LED light module and configured for initiating at least one protective action if the temperature of said LED light module rises to a predetermined temperature, $T_{THR}$.

9. A range hood appliance as in claim 8, wherein said at least one protective action is selected from the group comprising reducing the power supplied to the LED light module, opening a damper to provide air for cooling the LED light module, activating a fan to provide to provide forced convection cooling of the LED light module; and terminating the power to the LED light module.

* * * * *